US011302224B2

(12) United States Patent
Haggar

(10) Patent No.: US 11,302,224 B2
(45) Date of Patent: Apr. 12, 2022

(54) TRI-FACE DISPLAY DEVICE

(71) Applicant: GAME DEV, CORP.

(72) Inventor: Frank Haggar, Coral Springs, FL (US)

( * ) Notice: Subject to any disclaimer, the term of this patent is extended or adjusted under 35 U.S.C. 154(b) by 0 days.

(21) Appl. No.: 16/192,720

(22) Filed: Nov. 15, 2018

(65) Prior Publication Data

US 2020/0242983 A1 Jul. 30, 2020

(51) Int. Cl.
*G09F 19/14* (2006.01)
*A47G 1/06* (2006.01)

(52) U.S. Cl.
CPC ..... *G09F 19/14* (2013.01); *A47G 1/06* (2013.01); *A47G 2001/0688* (2013.01)

(58) Field of Classification Search
CPC ... G09F 19/14; A47G 1/06; A47G 2001/0688; B44F 1/10
See application file for complete search history.

(56) References Cited

U.S. PATENT DOCUMENTS 342,076 A * 5/1886 De Lano ..... G09B 17/00 434/172
922,015 A * 5/1909 Miller ..... G09F 19/14 40/453
1,353,363 A * 9/1920 Simon ..... G09F 19/14 40/453
2,847,783 A * 8/1958 Anderson ..... B44F 1/10 40/453
3,135,063 A * 6/1964 Ricks ..... G09F 19/14 40/473
4,282,669 A * 8/1981 Rieumont ..... G09F 19/14 40/453
5,207,334 A * 5/1993 Lear ..... A47J 47/16 211/184
6,023,866 A * 2/2000 Polsky ..... G09F 19/14 40/453
2021/0045551 A1* 2/2021 Haggar ..... G09F 19/14

* cited by examiner

*Primary Examiner* — Cassandra Davis
(74) *Attorney, Agent, or Firm* — Sanchelima and Associates PA; Christian Sanchelima; Jesus Sanchelima

(57) ABSTRACT

A tri-face artwork display device that allows for three different views within the same frame. One embodiment includes upper and lower rows of corresponding slits on the top and bottom of the frame. The slits have a predetermined depth so as to not penetrate through the other side of the frame. The slits hold the image panels that display the second and third image to compliment the first image. The image panel has a second image on its first face and a third image on its second face. The present invention includes a second embodiment that is used to retrofit an existing standard frame. The fillet assembly uses a plurality of receiving cavities defined by two side walls to hold image panels. The fillet may also have a locking flange, which extends perpendicular from the fillet and fits underneath the matting of a frame to securely hold the fillet in place.

11 Claims, 6 Drawing Sheets

TRI-FACE DISPLAY DEVICE

FIELD OF INVENTION

The present invention relates to tri-face artwork display, and more particularly such a device that includes upper and lower slits on a frame and/or a fillet assembly to mount a plurality of image panels thereon.

DESCRIPTION OF THE RELATED ART

Several alternative designs for tri-faced image displays have been created in the past including U.S. Pat. No. 6,023,866A (the "Polsky Patent") and EU Patent 1,449,679 (the "Kmoth Patent" a.k.a. the "Vom Blickwinkel Patent".)

The first reference, the Polsky Patent, teaches a "triple-view picture kit" and discloses a toy that "allows the user to place panel [strip-like picture elements] in a staggered array so that different pictures are seen from different angles." The Polsky Patent discloses a frame with top and bottom slits for the vertical pictures to be inserted. These strip-like picture elements can be attached together in a sheet to be colored or drawn on. Where after they are separated and subsequently mounted in a sequential order inside the slits of a box frame. Unlike the box frame in Polsky, the frame in the present invention is not folded. Rather it is sturdy and rigid providing a better fit and support for the inserts.

The Vom Blickwinkel Patent teaches vertical slits within the base of an element used to insert pictures to create one continuous free-flowing image. None of the prior art teaches a fillet assembly containing two complimentary rows of receiving cavities along the top and bottom, slits that have a predetermined depth that stops short of penetrating through the frame, an adaptor that is inserted into the slits or the fillet assembly, a fillet having a locking flange to fit under a matting of a frame to secure the fillet to the frame, or a breakaway fillet design that allows the user to adjust the length of the fillet to fit in various sizes of picture frames and mattings.

The present invention may use a fillet assembly to secure the picture, as opposed to Vom Blickwinkel which only uses slits within the base element. Also, Vom Blickwinkel is more of a free-flowing picture unlike the present invention that has a plurality of slits adapted to receive a variety of different sized picture elements.

One of the differences in the present invention is that it offers a way to retrofit standard picture frames. The fillet assembly can retrofit existing pictures frame by using the fillets on two opposite sidewalls. The Vom Blickwinkel reference consists of receiving cavities that go along the bottom of the frame, instead of vertically. The present invention uses receiving cavities defined by two opposite side walls to secure the picture and increase structural integrity, as opposed to Vom Blickwinkel that only uses slits on one side wall on the bottom of the base element.

In contrast to the Polsky reference, which has slits along the top and the bottom base element that go all the way through the frame, the present invention offers a frame with slits that stop short of penetrating through the frame. These slits offer a side support structure that secures the frames in place and keep them from bending.

Additionally, the adapter element that fits inside the fillet and/or slits to better hold the vertical picture elements is not anticipated by the prior art.

SUMMARY OF THE INVENTION

It is one of the objects of the present invention to provide a way to retrofit standard picture frames with fillets to fit with three diagonal pictures so that each photo is visible from a different angle. The fillets can be made of a variety of materials such as paper or rubber. Another object of the present invention is to provide a breakaway design to allow the user to adjust the length of the fillet to fit in a variety of frames. Another object of the present invention includes a frame element with slits along the top and bottom which provides structural integrity. The slits do not penetrate all the way through the structure which provides a more aesthetically pleasing and marketable display device. Lastly, the present invention provides an adapter that may be mounted within the receiving cavity to better conform to the size of the image panel selected by the user.

DETAILED DESCRIPTION OF THE INVENTION

Figure 1:
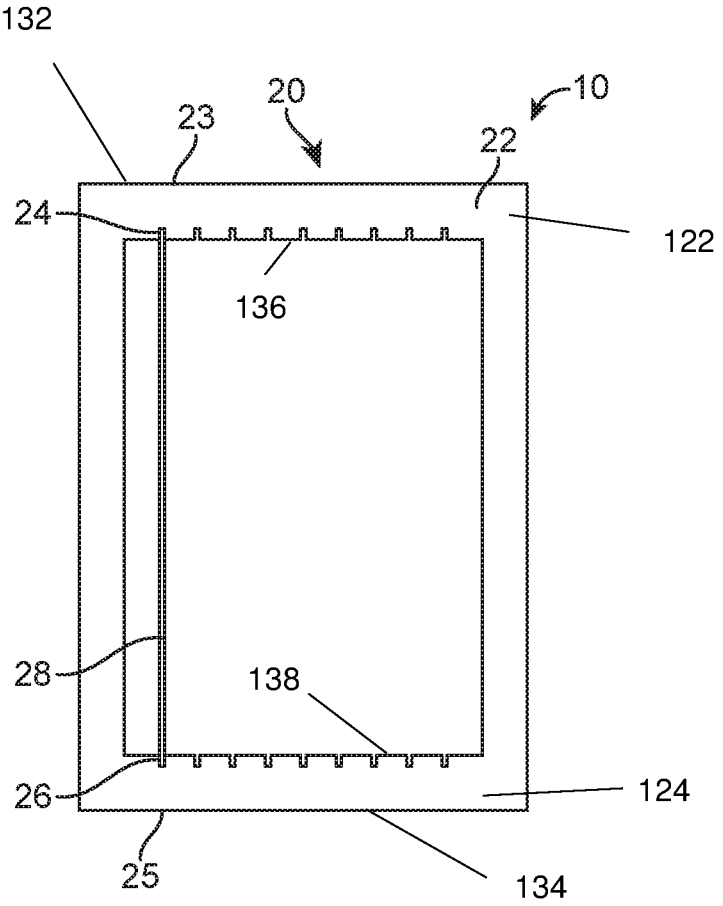
FIG. 1 is a front view of one of the embodiment of the present invention, showing upper slits 24 and lower slits 26 on a frame 22.

FIG. 1 shows the frame 22 having a squared shape and four borders having a certain thickness to maintaining a squared shape along the edges of the frame 22 with a top side 23, a bottom side 25, a top distal end 132 and a bottom distal end 134. A plurality of the upper slits 24 and the lower slits 26 are located along the length of the inner portion of the top side 23 and the bottom side 25 of the frame 22. The upper slits 24 and the lower slits 26 are visible when looking at the frame 22 from the front, in a way that vertical picture objects can be inserted through the front of the frame 22. A first picture is held inside the frame 22, a second image is portrayed on the first side of the image panel 28, and a third image is portrayed on the second side of the image panel 28. A plurality of the image panel 28 are held in a vertical position with respect to the upper slits 24 and the lower slits 26 in a way that three pictures are visible by the looking at the frame 22 from different angles. The spacing of the upper slits 24 and the lower slits 26 can vary to control the viewing angle. With the slits spaced at a one slit per one inch of fillet the viewer needs to view the frame from a greater viewing angle to see the complete image. However, when the slits are spaced closer together, the viewer can view from a more front facing viewing angle position to see the complete image.

The bottom side 25 has a bottom front face 124 and a bottom side upper surface 138, creating a squared shape along the edges of the frame 22. A plurality of the lower slits 26 are located along the length of the bottom side upper surface 138. The lower slits 26 extend vertically with respect to the bottom side upper surface 138 from the bottom front face 124 to a bottom rear face 128.

The upper slits 24 and the lower slits 26 are visible when looking at the frame 22 from the front, in a way that vertical picture objects can be inserted through the front of the frame 22. A first picture is held inside the frame 22, a second image is portrayed on the first side of the image panel 28, and a third image is portrayed on the second side of the image panel 28. A plurality of the image panel 28 are held in a vertical position with respect to the upper slits 24 and the lower slits 26 in a way that three pictures are visible by the looking at the frame 22 from different angles.

Figure 1A:
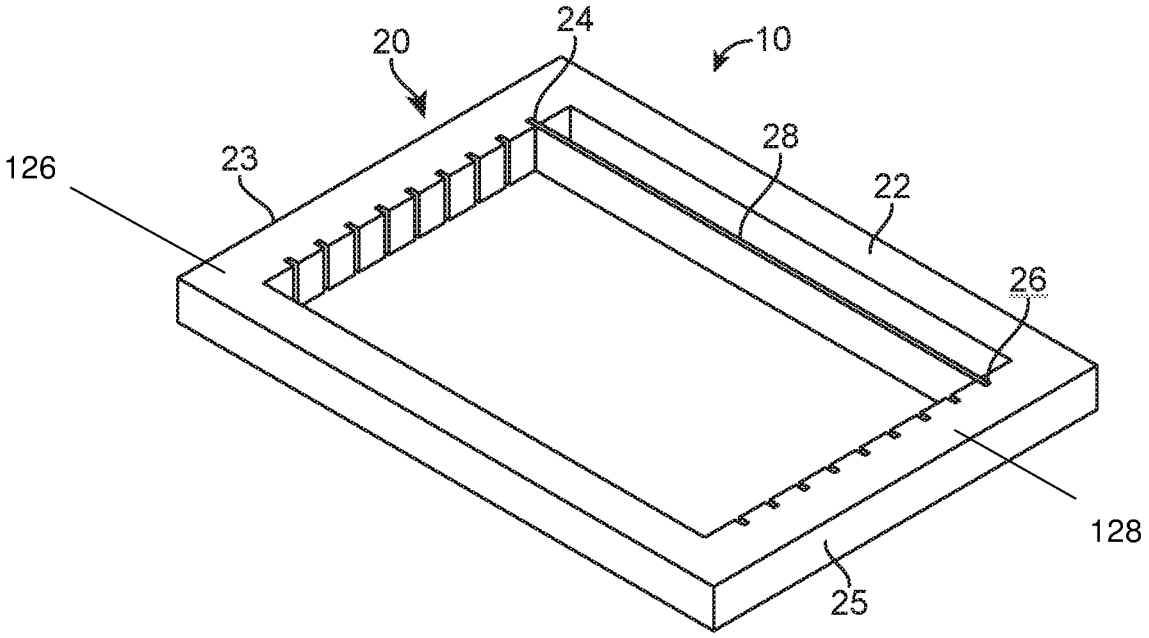
FIG. 1A is a left isometric view of the embodiment of FIG. 1 showing a second image within the frame 22.

FIG. 1A shows the top rear face 126 and the bottom rear face 128. The upper slits 24 extent to the top rear face 126 and the lower slits 26 extend to the bottom rear face 128.

Figure 1B:
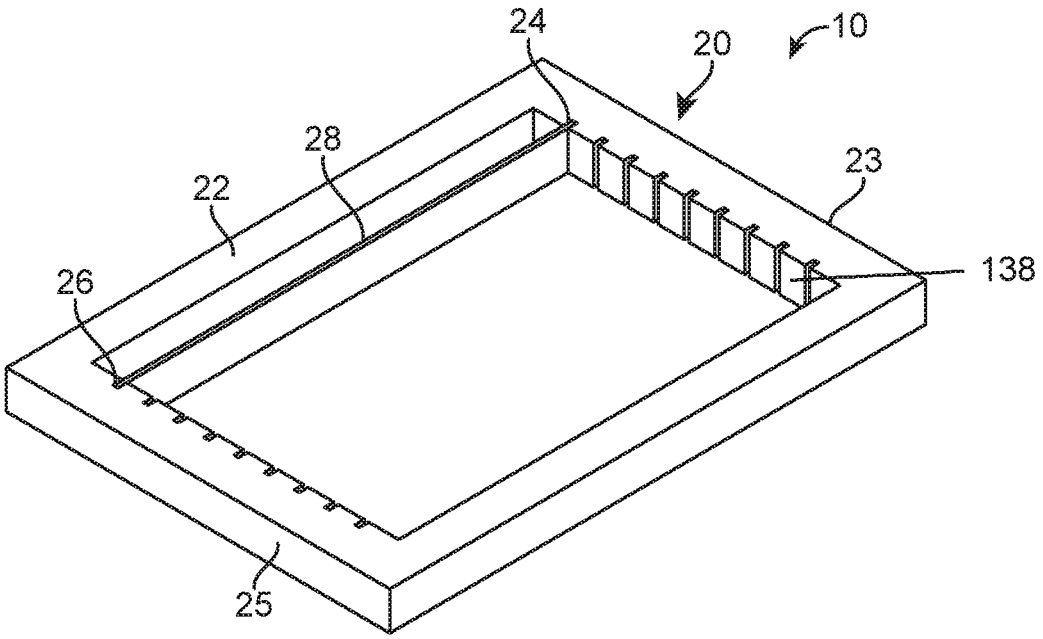
FIG. 1B is a right isometric view of the embodiment of FIG. 1 showing a third image within the frame 22.

FIG. 1B shows the top side 23 having the top side lower surface 136. The upper slits 24 are located along the length of the top side lower surface 136. The upper slits 24 have a predetermined depth that allows for the image panel 28 to be inserted into the upper slits 24. The bottom side 25 likewise, has the lower slits 26 located along the length of the bottom side upper surface 138 where the image panel 28 is inserted.

Figure 2:
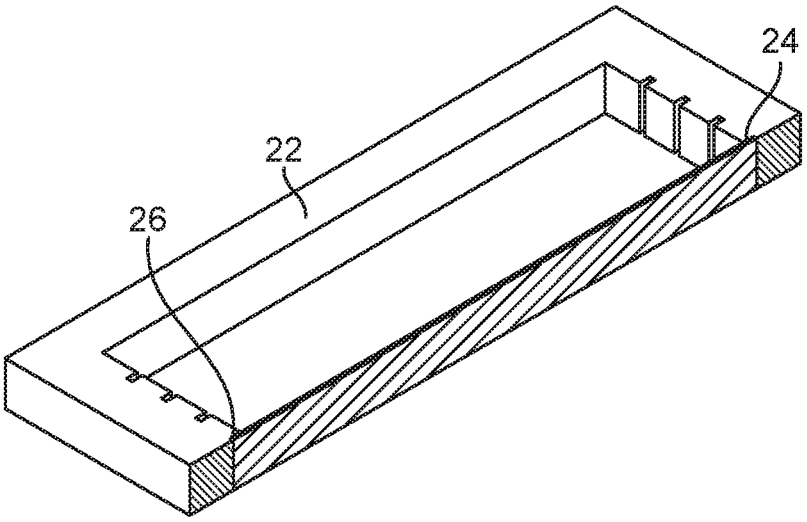
FIG. 2 is a cross-sectional view of the frame 22 shown in FIG. 1 revealing the depth of the upper slits 24 and the lower slits 26 within top side 23 and bottom side 25 respectively.

FIG. 2 shows the depth of the upper slits 24 and the lower slits 26 stopping short of penetrating through the top side 23 and the bottom side 25 respectively. The depth of the upper slits 24 and the lower slits 26 may be increased by adding material blocks, or "build-ups" 27 to the spaces between both upper slits 24 and lower slits 26. The build-ups 27 may be stacked to create a more desired slit depth. The build-ups 27 can be made of a variety of materials including rubber, paper, cardboard, wood, plastic, or any other material capable of providing structure.

Figure 3:
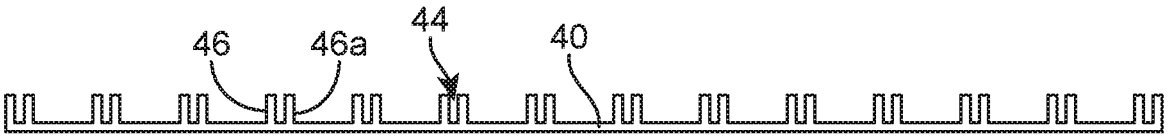
FIG. 3 is a front elevational view of an alternate embodiment of the present invention showing fillet assembly 40 having a plurality of receiving cavities 44 defined by side walls 46 and 46*a*.

FIG. 3 shows the fillet assembly 40 having a plurality of receiving cavities 44 having an interior space defined by side walls side walls 46 and 46*a*. The receiving cavities 44 maintain an interior space within each of the side walls 46 and 46*a* wherein the image panel 28 is inserted in a way that the image panel 28 is vertically held with respect to the fillet assembly 40.

Figure 4:
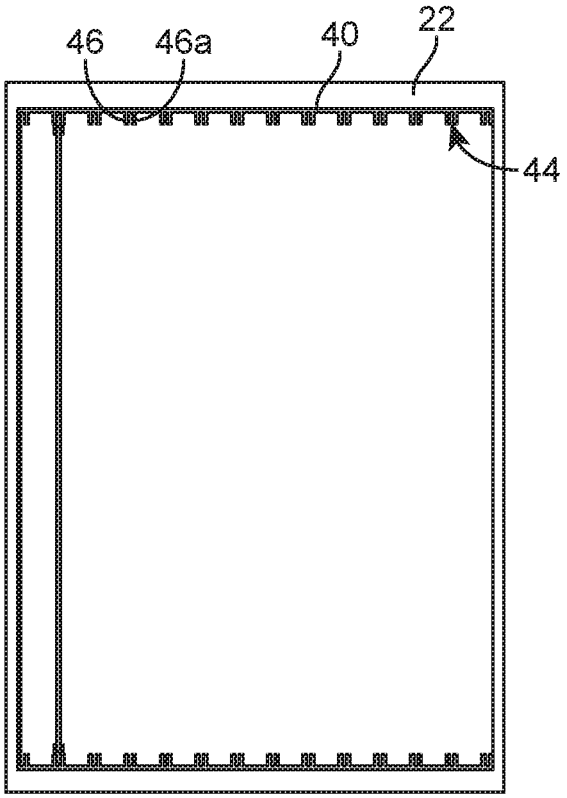
FIG. 4 is a front elevational view of the alternate embodiment showing the frame 22 retrofitted with the fillet assembly 40 to convert the single image display into a tri-faced image display.
Figure 4A:
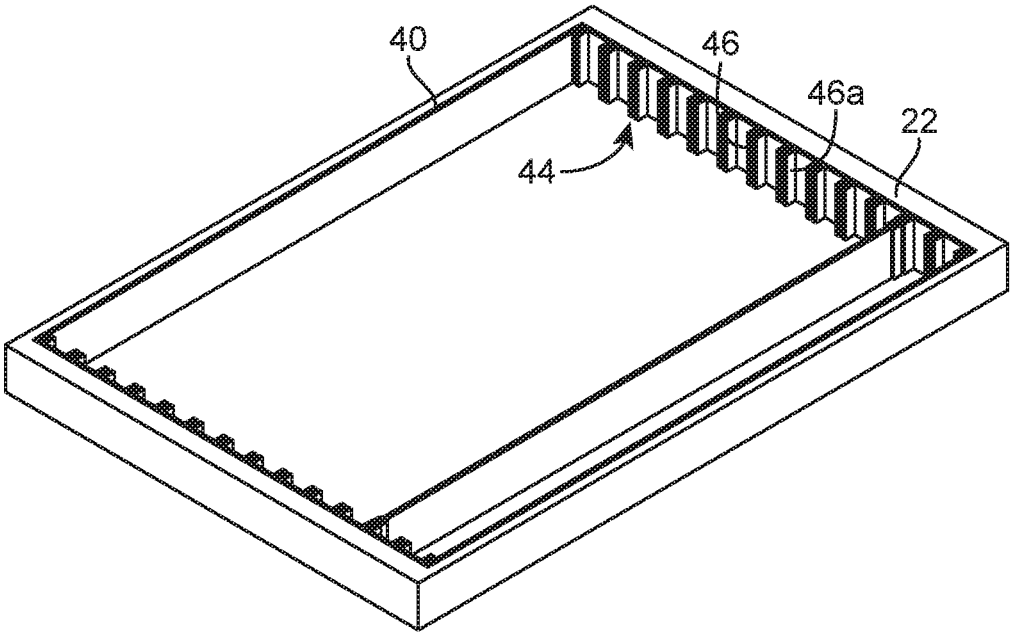
FIG. 4A is a left isometric view of the alternate embodiment shown in FIG. 3.
Figure 4B:
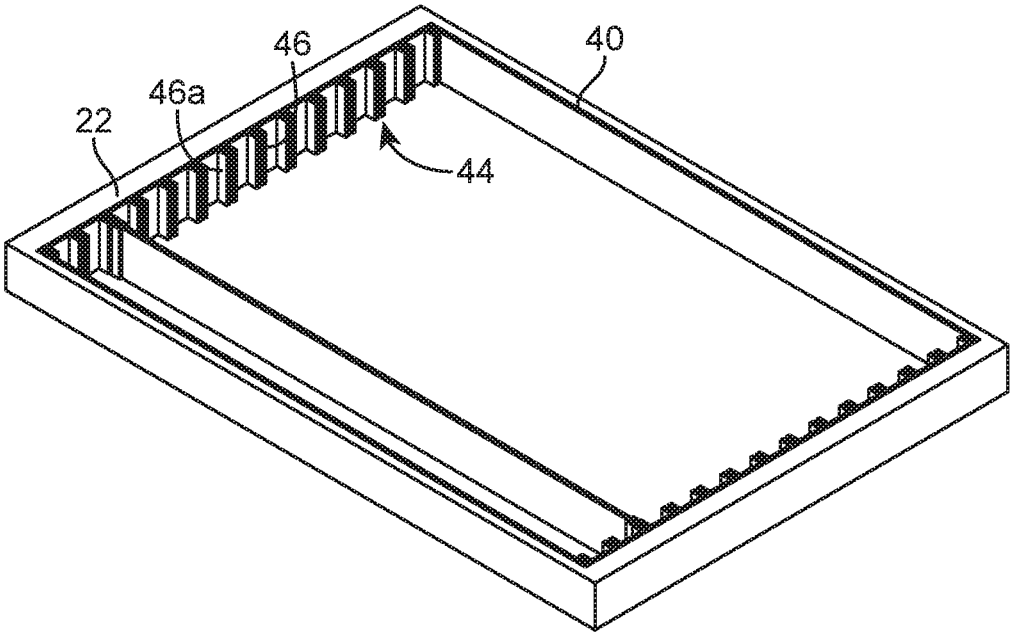
FIG. 4B is a right isometric view of the alternate embodiment shown in FIG. 3.

FIG. 4 shows the frame 22 retrofitted with the fillet assembly 40. A plurality of the image panels 28 are inserted in the receiving cavities 44 in a way that three pictures are visible by the looking at the frame 22 retrofitted with the fillet assembly 40 from different angles. The fillets 40 may be rounded or angular. The fillets may also be made out of paper. The paper design contains perforations to allow the user to easily fold and assemble the fillet 40.

Figure 5:
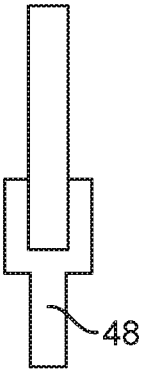
FIG. 5 is a front elevational view of the alternate embodiment shown in FIG. 4 having adapters 48.

FIG. 5 shows the fillet assembly 40 having the adapter 48. The adapter 48 has a bottom center wall having a distal end. The distal end is inserted into the receiving cavities 44 of the fillet assembly 40. The image panel 28 is inserted in the adapter receiving cavity of the adapter 48, in a way that the image panel 28 is vertically held with respect to the adapter receiving cavity of the adapter 48.

Figure 5A:
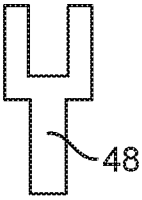
FIG. 5A is a front elevational view of the adapter 48.

FIG. 5A shows the adapter 48 having the adapter receiving cavity defined by an adapter first side wall, an adapter second side wall, and the bottom center wall. Adapter 48 allows for the adjustment of the receiving cavities 44 in the case that the image panel 28 has a smaller or larger thickness with respect to receiving cavities 44. The use of the adapter 48 thus allows fillet assembly 40 to hold different sizes of the image panel 28.

Figure 6:
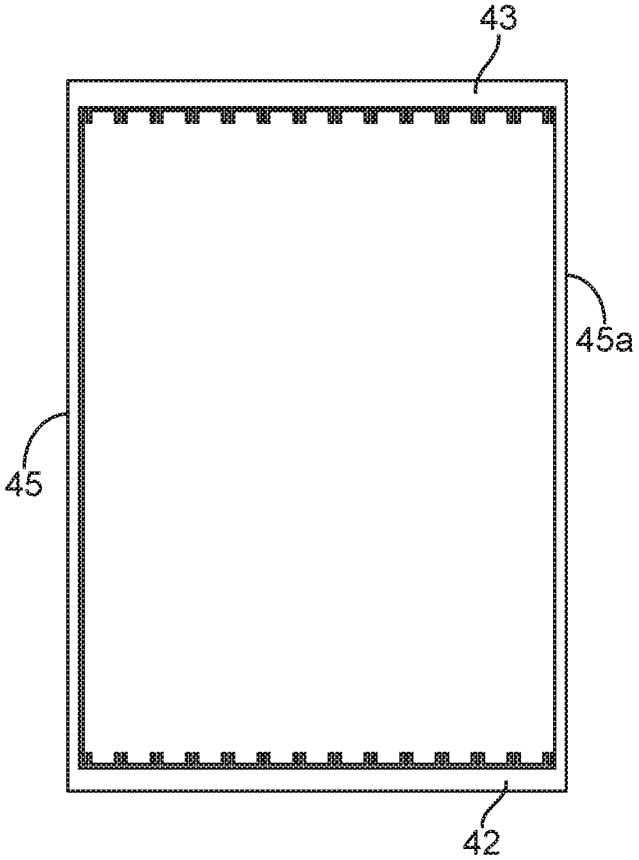
FIG. 6 is the fillet assembly 42 connected to a top fillet member 43 by side walls 45 and 45*a*.

FIG. 6 shows a fillet assembly 42 connected to a top fillet member 43 through the integration of the side walls 45 and 45*a*. The side walls 45 and 45*a* resemble a thin border made of a certain material that allows the side walls 45 and 45*a* to maintain a vertical direction with respect to the fillet assembly 42 and the top fillet member 43. The fillet assembly 42, the top fillet member 43, and the side walls 45 and 45*a* may be inserted into a picture frame or into the frame 22 in order to create a single image display into a tri-faced image display.

Figure 7:
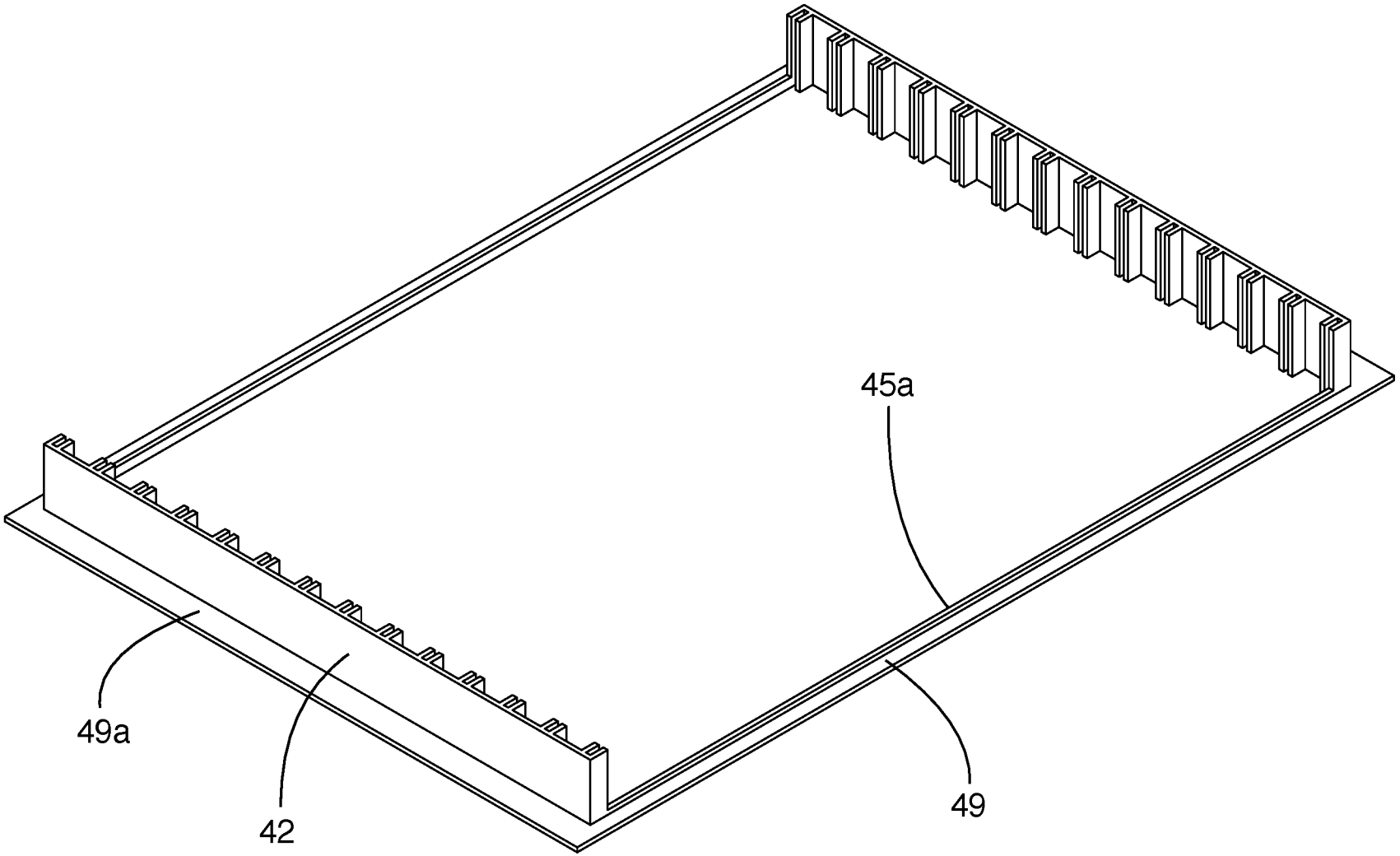
FIG. 7 is the fillet assembly 42 attached to side walls 45 and 45*a*.

FIG. 7 shows a fillet assembly 42 connected to a top fillet member 43 through the integration of the side walls 45 and 45*a*. The fillet assembly 42 has an attached locking flange 49*a* that extends perpendicularly from the surface of the fillet assembly 42 to fit under the matting of a frame. The sidewall 45*a* has an attached sidewall locking flange 49 that extends perpendicularly from the surface of the sidewall 45*a* to fit under the matting of the frame. The locking flange 49*a* and the sidewall locking flange 49 allow the insertion of the trifaced image display into a frame being held down by the frame matting. Fillets without the locking flanges 49, 49*a* can be used in frames without mattings, such as a shadow boxes.

Figure 8:
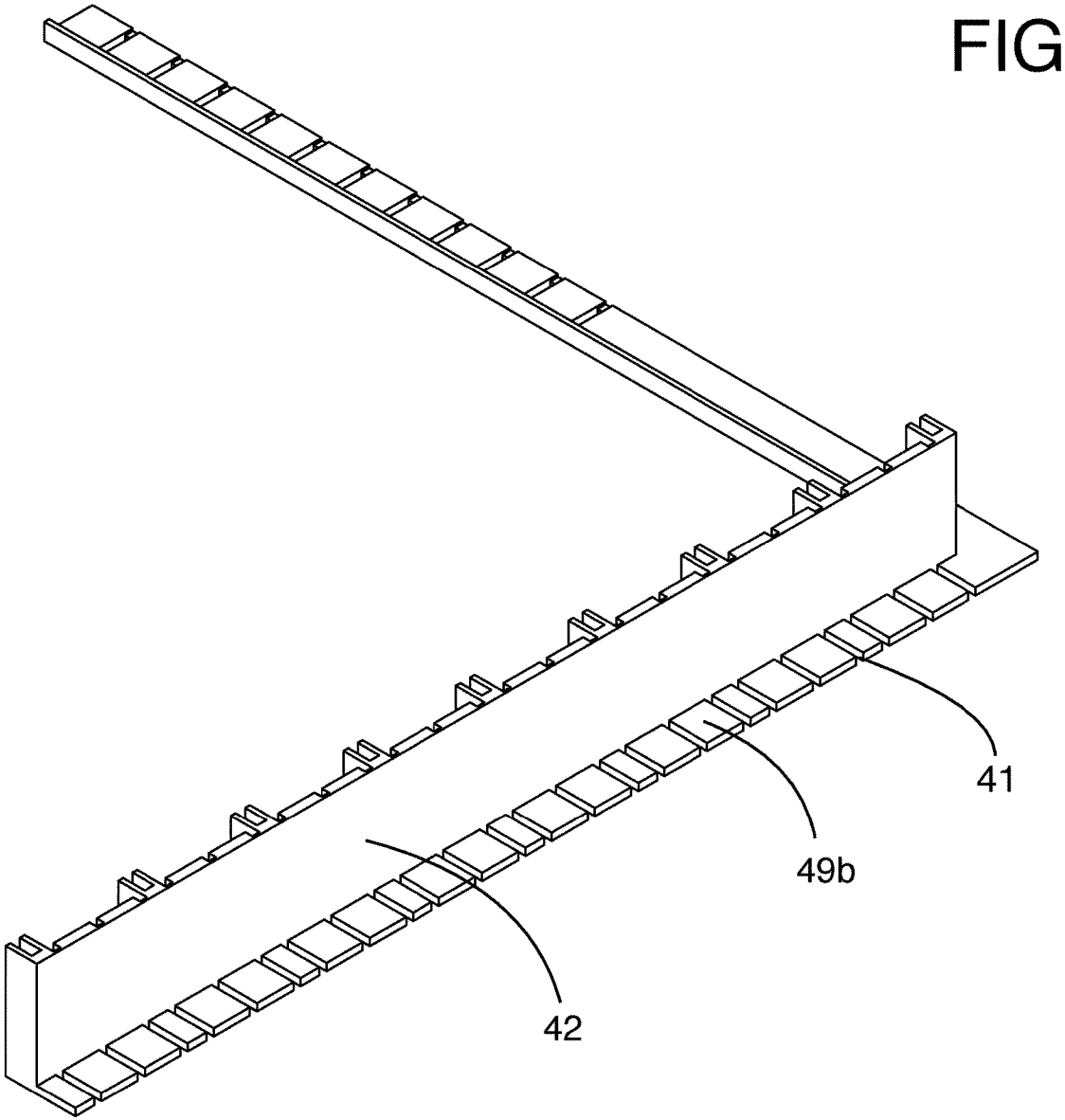
FIG. 8 is the fillet assembly 42 with attached fillet locking flange 49*b*.

FIG. 8 shows a fillet assembly 42 and an attached fillet locking flange 49*b* that has an array of slots 41 that allow the user to snap off parts of the fillet assembly 42 to create a custom sized trifaced image display.

What is claimed is:

1. A tri-faced image display, comprising:

a frame assembly having a thickness, a top distal end, and a bottom distal end; said frame assembly having a top side that includes a top side lower surface having a top side length, and a bottom side that includes a bottom side upper surface having a bottom side length; said top side and said bottom side being connected and; said top side containing upper slits along the length of said top side; said bottom side containing lower slits along the length of said bottom side; said upper slits and said lower slits inserted into said top side lower surface and said bottom side upper surface, respectively, a first predetermined depth through the top distal end and the bottom distal end of the frame, respectively, said upper and lower slits inserted along said top side length and said bottom side length, respectively, said upper and lower slits each adapted to receive an image panel, wherein said top side includes a top front face and a top rear face, said bottom side includes a bottom front face and a bottom rear face, said upper slits extending into said top front face a second predetermined depth through said top rear face, said lower slits extend from said bottom front face to said bottom rear face.

2. The tri-faced image display of claim 1 wherein said image panel includes a front side having a first image and a second side having a second image, said frame houses a third image.

3. The tri-faced image display of claim 1 wherein said frame includes upper slits that extend from said top front face to said top rear face.

4. The tri-faced image display of claim 1 wherein said upper slits extend from said top front face to said top rear face, and said lower slits extend from said bottom front face to said bottom rear face.

5. A tri-faced image display, comprising:

a frame, a fillet assembly mounted to said frame; said fillet assembly including an upper fillet member and a lower fillet member each having a base and a plurality of receiving cavities; said receiving cavities having an interior space defined by two opposite side walls extending from said base, said receiving cavities receiving an image panel, the fillet assembly further including a fillet locking flange, the fillet locking flange is perpendicular to a bottom surface of a bottom portion of the fillet assembly, the fillet locking flange engages with a rabbet of the frame, the upper fillet member and the lower fillet member connected via sidewalls.

6. The tri-faced image display of claim 5 wherein said image panel includes a front side having a first image and a second side having a second image, said frame houses a third image.

7. The tri-faced image display in claim 5 said frame includes a top side having a top side lower surface, said frame has a bottom side that includes a bottom side upper surface said upper fillet member mounted on said top side lower surface, said lower fillet member mounted on said bottom side upper surface.

8. The tri-faced image display in claim 7, wherein an adapter is at least partially inserted inside at least one of said receiving cavities to accommodate image panels of varying thicknesses.

9. The tri-faced image display of claim 5 wherein said fillet assembly is made of rubber.

10. A tri-faced image display of claim 5 wherein said fillet locking flange and said each base has a plurality of slits adapted to allow a user to break said base into segmented portions based on the length desired for said base.

11. A tri-faced image display, consisting of:

a frame, a fillet assembly mounted to said frame, said fillet assembly including an upper fillet member and a lower fillet member each having a base and a plurality of receiving cavities; said receiving cavities having an interior space defined by two opposite side walls extending from said base, said receiving cavities receiving an image panel, said image panel includes a front side having a first image and a second side having a second image, said frame houses a third image, the fillet assembly further including a fillet locking flange, the fillet locking flange is perpendicular to a bottom surface of a bottom portion of the fillet assembly, the fillet locking flange engages with a rabbet of the frame, thereby orienting the upper fillet member and the lower fillet member to extend past each of a top front face and a bottom front face of the frame respectively, the upper fillet member and the lower fillet member connected via sidewalls, the fillet assembly including an adapter at least partially inserted inside at least one of said receiving cavities to accommodate image panels of varying thicknesses, said fillet assembly being made of a rubber material, the fillet locking flange and said base having a plurality of slits adapted to allow a user to break said base into segmented portions based on the length desired for said base.

* * * * *